US005735739A

United States Patent [19]

Daigle et al.

[11] Patent Number: 5,735,739

[45] Date of Patent: Apr. 7, 1998

[54] INSULATED EXTERNAL EXHAUST'S END

[76] Inventors: Jean Yves Daigle; Michelle Landry, both of 533 Rue Nicole, Lar St-Charles Quebec, Canada, G0A 2H0

[21] Appl. No.: 380,669

[22] Filed: Jan. 30, 1995

[51] Int. Cl.[6] ..... F23L 17/02

[52] U.S. Cl. ..... 454/359; 454/353; 454/360

[58] Field of Search ..... 34/235; 137/494; 454/347, 352, 353, 358, 359, 360, 361, 363

[56] References Cited

U.S. PATENT DOCUMENTS 1,369,099 2/1921 Hanson ..... 454/363

2,551,965 5/1951 Petersen et al. ..... 454/361

FOREIGN PATENT DOCUMENTS 2076528 12/1981 United Kingdom ..... 454/363

*Primary Examiner*—Harold Joyce

[57] ABSTRACT

An outdoor exhaust's end of part of an indoor building system requiring an exhaust duct to evacuate air or other kinds of smoke or gases to the building's outside. The exhaust's end comprising a double enclosure that prevents the outdoor air from comming into the building by the exhaust duct and captures an air chamber in a rotary inner cylinder, which act like a thermal insulation between the inlet and the outlet of the exhaust's end. A trap located on the rotary inner cylinder is activated by the exhaust flow, that comes upward and rotate the inner cylinder, permitting to the exhaust flow to past through an opening located under the trap, to come in the cylinder and flow out by a second opening. The exhaust flow out by the outlet downward duct, that protect the exhaust's end against rain or snow without restricting the flow.

3 Claims, 3 Drawing Sheets

INSULATED EXTERNAL EXHAUST'S END

BRIEF SUMMARY OF THE INVENTION

This invention is about a system permitting a thermal insulation with the building's outside, adaptable on an exhaust duct for indoor device like clothes dryer, which requiring an exhaust duct to evacuate air or other kinds of smoke or gases to the building's outside. This invention prevent the outdoor air to come into the building by the exhaust duct or for the inner heat of the building to exit by the exhaust duct when the indoor device like clothes dryer is not in use.

Its a good practice to install on an exhaust duct, a system that prevent the air from flowing through the exhaust duct when the device is not in use. To do that, a small trap is installed, which is pushed open by the exhaust flow and closes by its weight or by a spring. Other systems work with small blades that operate in the same way, but have the same disadvantages of not being very well insulated or full sealed when they are not in use. The system with spring take more power from the exhaust flow to open the trap and that power is take away from the device's motor.

I found that if we have an exhaust's end with a double enclosure, by retaining an amount of air between the two closings, a thermal insulation will be create between the inlet and the outlet of the enhaust's end. So, I conceive a system constituted by a rotary cylinder free to rotate perpendicular to the exhaust flow between two stoppers, comprising two openings and a trap located under an inlet opening, so that the exhaust flow by pushing on the trap, rotate the inner cylinder and move the two openings in the axis of the inlet and the outlet ducts of the exhaust's end. When no exhaust flow appear, the trap act like a counterweight, which rotate the inner cylinder in a reverse motion for close the inlet and outlet cylinder's openings and by retaining an amount of air in this inner cylinder, produce a thermal insulation between the inlet and outlet of the exhaust's end.

BRIEF DESCRIPTION OF THE DRAWING(S)

In drawings which illustrate embodiments of the invention:

The FIG. 1 is a perspective view of the inside mechanism of the new design.

The FIG. 2 is a front cut view thereof in an open position.

The FIG. 3 is a front cut view thereof in an closed position.

BEST MODE FOR CARRYING OUT THE INVENTION

Figure 1:
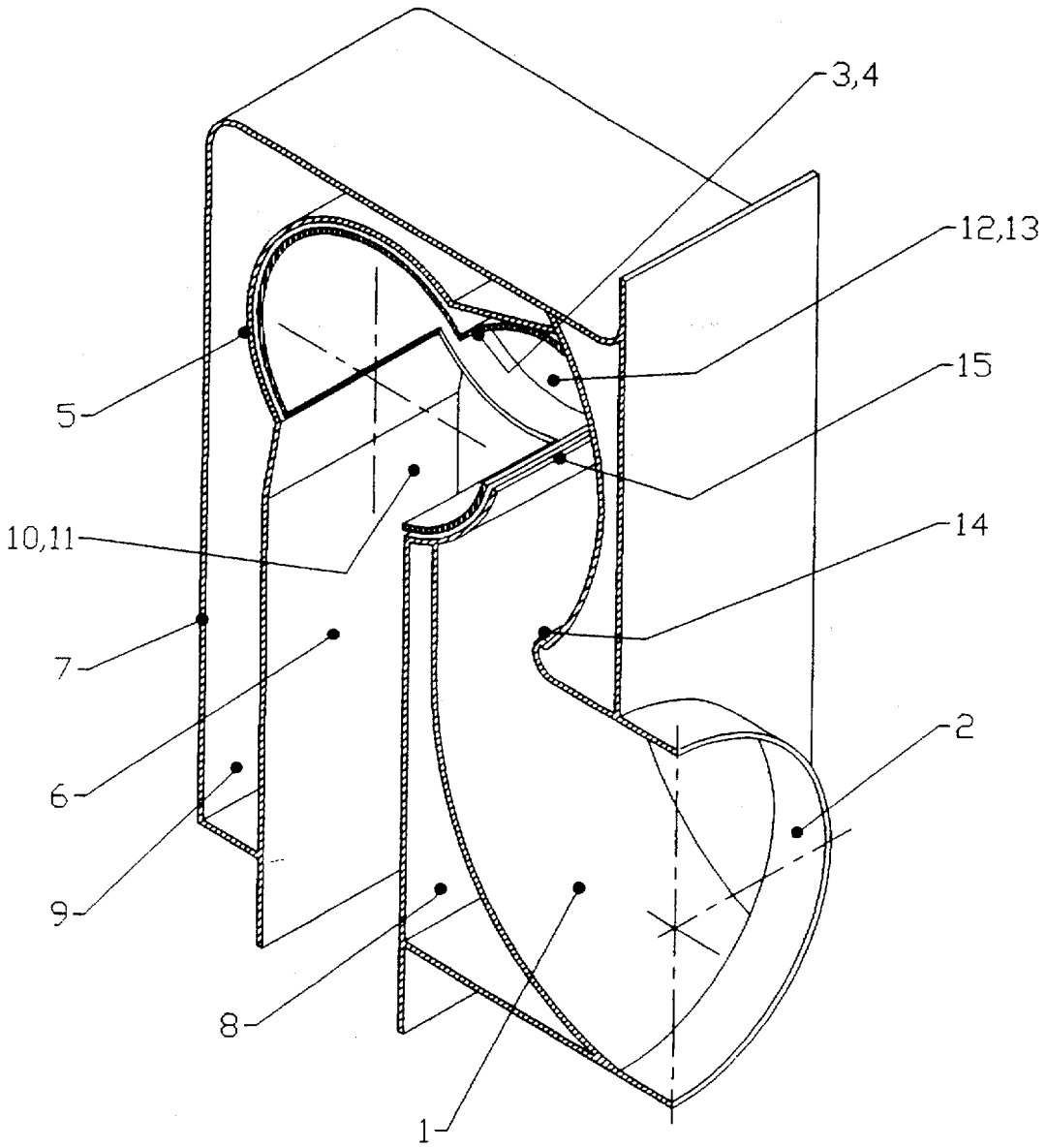
Figure 2:
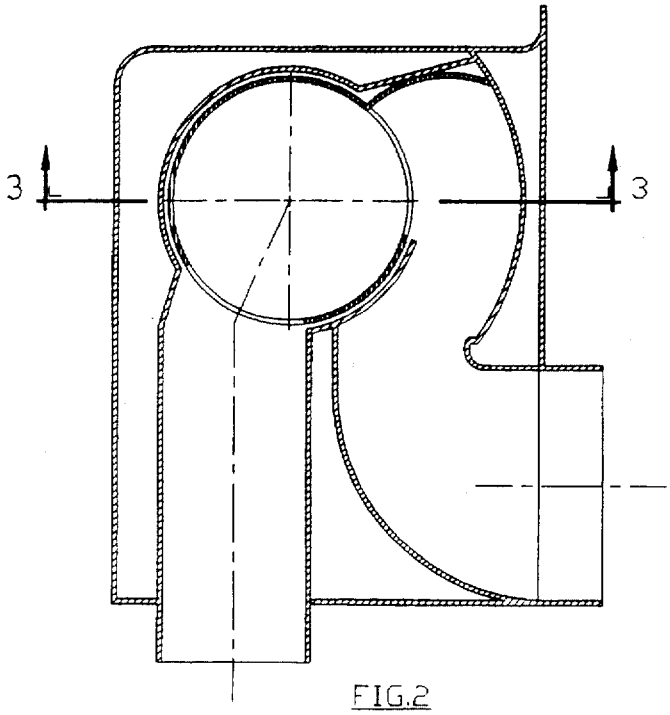
Figure 3:
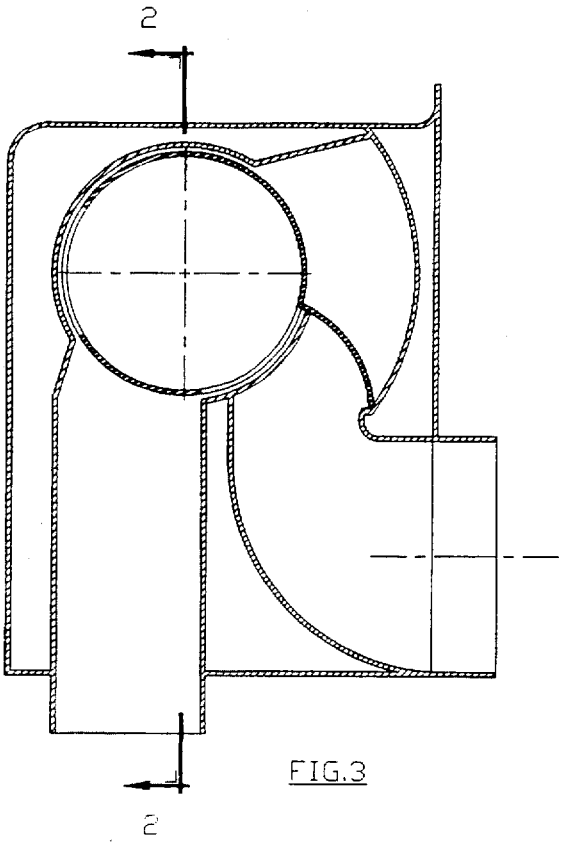
Figure 4:
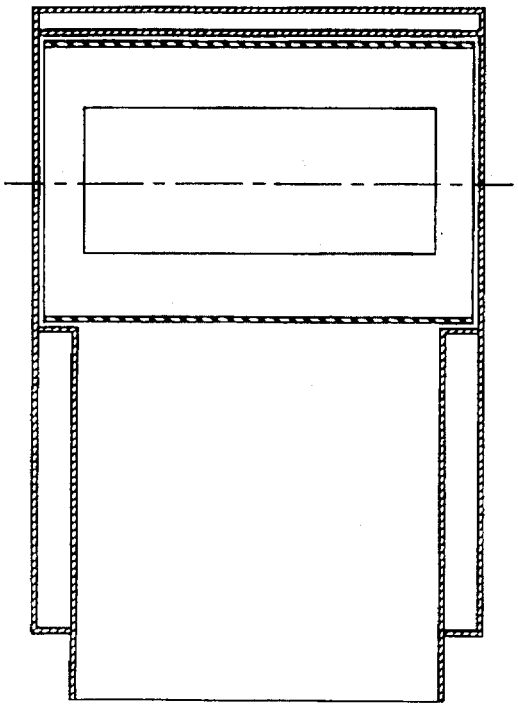
FIG. 4 is a cross sectional view taken along line 2—2 of FIG. 3.
Figure 5:
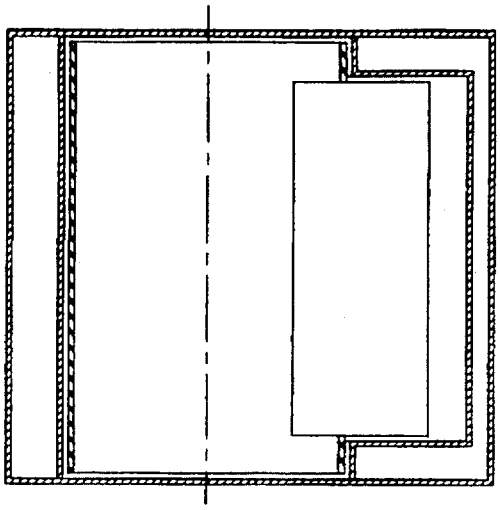
FIG. 5 is a cross sectional view taken along line 3—3 of FIG. 2.
Figure 6:
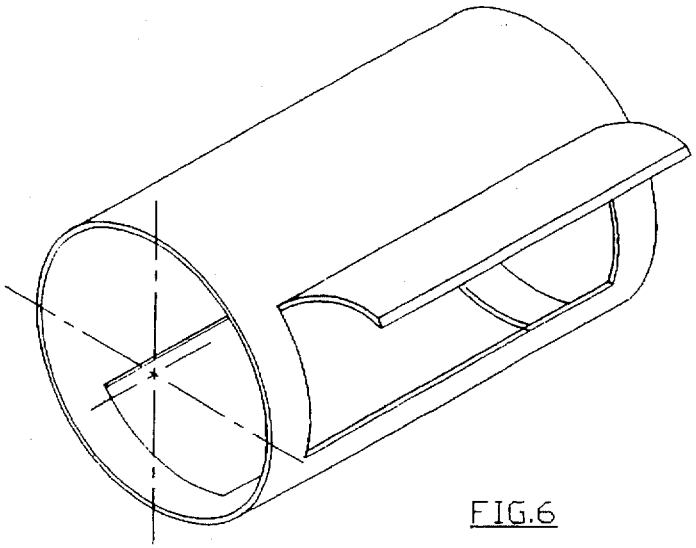
FIG. 6 is a perspective view of the inner cylinder.

This invention is constituted by a case 7, comprising an intake duct 1 with a fixture or attachment 2 for the device's exhaust duct located in the building's inside, a trap 3 fixed on an inner cylinder 4 surface at a small angle and above the cylinder inlet opening 11, outlet duct 6. The inner cylinder 4 can freely rotate in a circular housing 5 in the case 7. Cavities 8 and 9 may be filled with insulating material. The case 7 includes two stoppers 12 and 13 enabling a tight seal for the trap 3 with the case 7 in close position. When the exhaust flows through the intake duct 1, it rotate the inner cylinder 4 by pushing upward the trap 3. Thus permitting to the exhaust flow to past through an inner opening 11 located under the trap 3, to come into the inner cylinder 4 and flow out by an outlet opening 10, which permitting to the exhaust flow to go out by the outlet downward duct 6. When no exhaust flow appear by the intake duct 1, the trap 3 act like a counterweight, which rotate the inner cylinder 4 in a reverse motion for rest the trap 3 on the stoppers 12 and 13. This inner cylinder 4 reverse motion close the openings 10 and 11, and by retaining an amount of air in this inner cylinder 4, produce a thermal insulation between the inlet and the outlet of the exhaust's end.

The embodiments of the invention in which an exclusive properly or privilege is claimed are defined as follows:

1. An exhaust device for allowing exhaust flow to go outside of a building comprising a case having an intake duct going upwardly within the case and an outlet duct going downwardly within the case, a rotary inner cylinder having an inlet opening and an opposite disposed outlet opening, said case having two curved outer walls between and in communication with said intake and outlet ducts, said curved outer walls rotably supporting said inner cylinder in a transverse direction for occluding and unoccluding the inlet and outlet openings or the inner cylinder, said rotary inner cylinder including a trap affixed thereto adjacent the upper portion of said inlet opening, said trap extends outwardly from said rotary cylinder so as exhaust flows upwardly within the intake duct, said inner cylinder is rotated by the exhaust flow forcing the trap upwardly thereby bringing the inlet opening and the outlet opening in unoccluding relationship with the curved outer walls and without the exhaust flow said inner cylinder is rotated by gravity forcing the trap downwardly thereby bringing the inlet opening and the outlet opening in occluding relationship with the curved outer walls.

2. The exhaust device of claim 1, wherein said two curved outer walls being in the form of an outer cylinder.

3. The exhaust device of claim 1, wherein a cavity is located between the case, and the intake duct, outlet duct, and curved outer walls; and insulation material being disposed within said cavity.

* * * * *